US005803563A

United States Patent [19]

Woodward

[11] Patent Number: 5,803,563

[45] Date of Patent: Sep. 8, 1998

[54] CABINET WITH REMOVABLE TAMBOUR DOOR

[75] Inventor: Bruce Woodward, Louisville, Ky.

[73] Assignee: National Products, Incorporated, Louisville, Ky.

[21] Appl. No.: 893,887

[22] Filed: Jul. 11, 1997

[51] Int. Cl.[6] ..... E06B 9/15

[52] U.S. Cl. ..... 312/297; 312/245; 160/37

[58] Field of Search ..... 312/297, 294, 312/242, 245, 263, 257.1; 109/5, 7, 11; 160/37, 36, 229.1

[56] References Cited

U.S. PATENT DOCUMENTS

| | | | |
|---|---|---|---|
| 1,159,859 | 11/1915 | Murphy | 312/297 X |
| 1,305,248 | 6/1919 | Bertram . | |
| 1,358,980 | 11/1920 | Olsen . | |
| 1,369,902 | 3/1921 | Miller et al. . | |
| 2,231,005 | 2/1941 | Gordon | 160/37 X |
| 3,044,841 | 7/1962 | Hein . | |
| 3,251,636 | 5/1966 | Hein . | |
| 3,351,405 | 11/1967 | Ferdinand et al. . | |
| 3,712,697 | 1/1973 | Kelly et al. | 312/297 |
| 3,837,041 | 9/1974 | Modert et al. | 312/297 X |
| 4,756,581 | 7/1988 | Phillips | 312/297 X |
| 5,255,970 | 10/1993 | Theosabrata | 312/297 |

FOREIGN PATENT DOCUMENTS

| | | | |
|---|---|---|---|
| 811277 | 8/1951 | Germany | 312/297 |
| 1434359 | 5/1976 | United Kingdom | 312/297 |

*Primary Examiner*—Peter M. Cuomo
*Assistant Examiner*—James O. Hansen
*Attorney, Agent, or Firm*—Middleton & Reutlinger; Charles G. Lamb

[57] ABSTRACT

A kitchen cabinet is provided with a removable tambour door. The kitchen cabinet is provided with a bottom wall having an open slot extending along a front portion of the bottom wall in alignment with inverted U-configured tambour door tracks wherein a tambour door is removable through the slot. A closure member is provided for the slot when the tambour door is in place.

8 Claims, 2 Drawing Sheets

CABINET WITH REMOVABLE TAMBOUR DOOR

BACKGROUND OF THE INVENTION

The present invention relates to a cabinet with tambour doors. More particularly, the present invention relates to kitchen cabinets having removable tambour doors.

Kitchen cabinets are provided with a number of different types of doors for closure and protection of the products stored inside the cabinets. Some of the cabinets are provided with pivotally attached doors which swing out into pathways and in many instances when the door is open clearance between the door and appliances and the like provides a cramped spaced within the kitchen. Improvements in some of these cabinets have included racks which extend inwardly into the cabinets whereby the doors, upon swinging outwardly, can also be pushed out of the kitchen pathways back into the cabinet. Retractable, sliding closures made of connected collapsible slats, movable in curved guideways, otherwise known as tambour doors, have been popular to cover and tidy the appearance of desks or cabinets quickly and particularly for cabinets where available space is at a premium.

SUMMARY OF THE INVENTION

An object of the present invention is to provide kitchen cabinets, and the like, with a tambour door which when opened is out of sight and out of the way.

Another object of the present invention is to improve the mounting of tambour doors in kitchen cabinets.

A further object of the present invention is to provide removable tambour doors in kitchen cabinets.

Also an object of the present invention is to provide removable tambour doors that will enable flexibility to homeowners in decorations.

More particularly, the present invention provides a cabinet comprising: a pair of spaced sidewalls and a back wall extending between the sidewalls; an intermediate wall disposed between the sidewalls and spaced parallel to and interiorly of the back wall; a bottom wall extending between the spaced sidewalls and having a slot therein disposed along a front portion of the bottom wall parallel to the intermediate wall and the back wall; tambour door tracks of inverted U-shaped configuration extending along opposed interior surfaces of the sidewalls having one downwardly terminating end of each track in alignment with the slot, the U-shaped configuration of said tracks having a first leg positioned on one side of said intermediate wall and a second long extending vertically on the opposite side of said interior wall with a base of said U-shaped tracks extending over a top of the intermediate wall and connecting the first and second legs; and, a removable tambour door mounted in said U-shaped tracks having a width less than said slot.

Other objects and advantages of the present invention can be understood by reference to the detailed description with reference to the accompanying drawings relative thereto.

DETAILED DESCRIPTION OF THE PREFERRED EMBODIMENT

Figure 1:
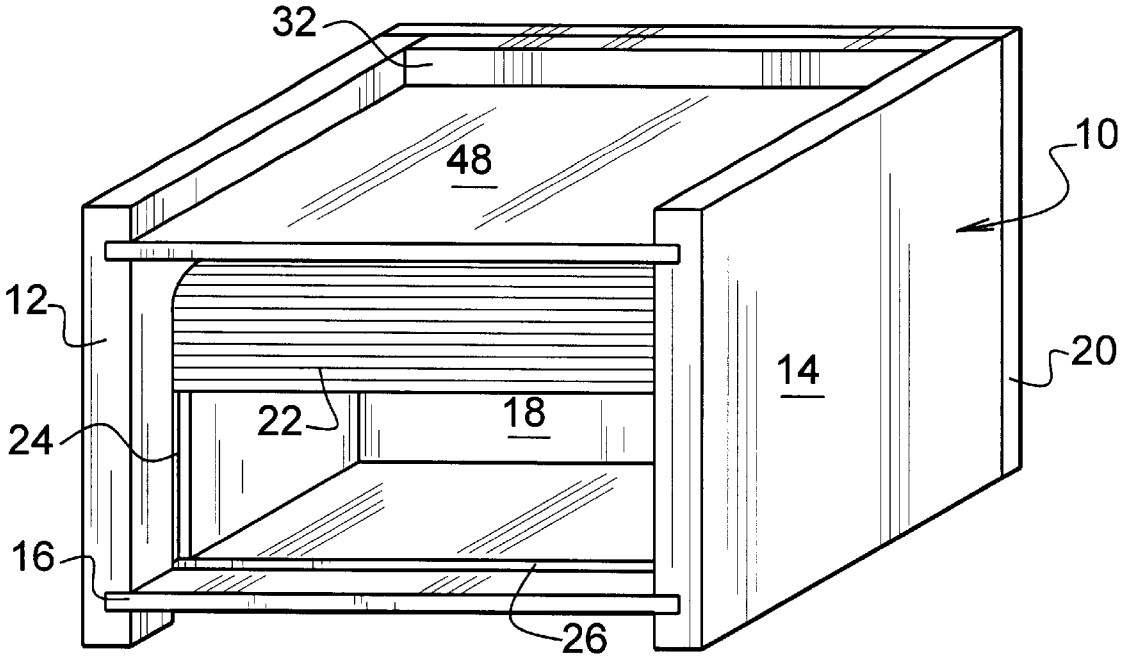
FIG. 1 is a perspective view of a preferred embodiment of the present invention showing a tambour door in a partially closed position.

In the preferred embodiment, as shown in FIG. 1, a kitchen cabinet 10 is provided with two opposed spaced sidewalls 12 and 14, a back wall 20, a top wall 48 and a bottom wall 26. An intermediate wall 18 is transversely disposed between and connected to the sidewalls 12 and 14, the intermediate wall 18 being spaced inwardly from the back wall 20. Kitchen cabinet 10 is also provided with a sliding door made of connected collapsible decorative slats, otherwise referred to as a tambour door 22.

Figure 2:
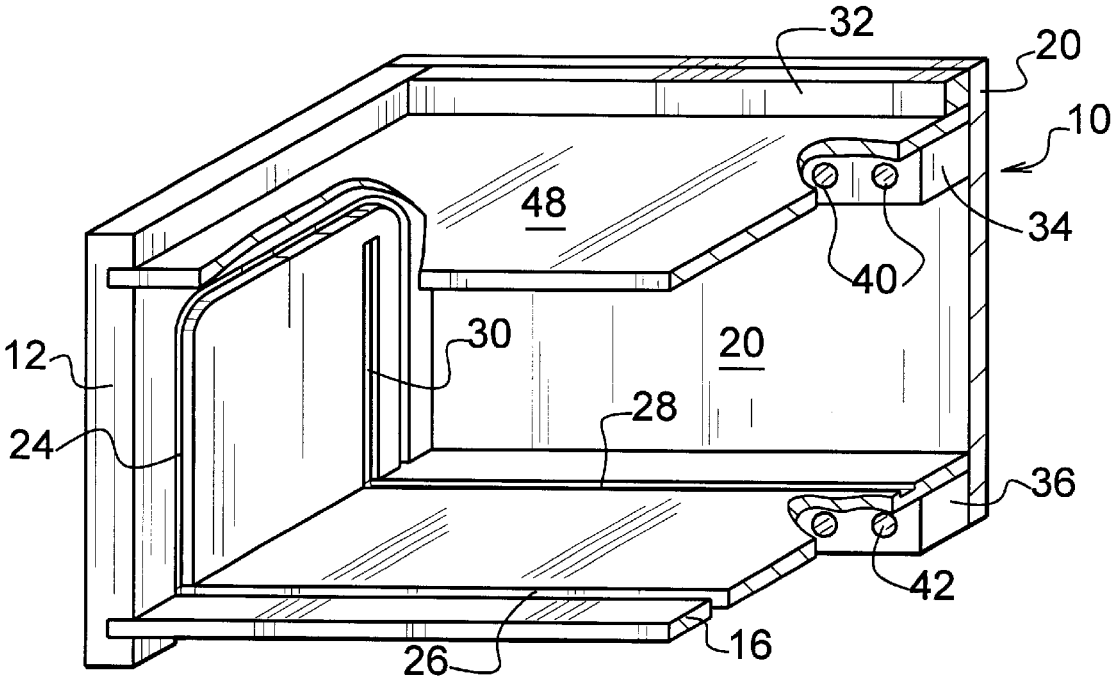
FIG. 2 is a perspective view of a kitchen cabinet of the present invention with selected portions removed.

The kitchen cabinet 10, as best shown in FIG. 2, is provided with a support member 32 which extends along the upper end of the back wall 20 and is connected to sidewalls 12 and 14. A top mounting block member 34 is provided wherein the mounting block member extends along the back edge of the top wall 48 and is disposed interiorly of and beneath said top wall 48. Mounting holes 40 are provided for appropriate mounting screws or bolts for attaching the cabinet to a wall. A bottom mounting block member 36 is also provided beneath the bottom wall 16, extending beneath the bottom wall 16 and between the sidewalls 12 and 14. Mounting holes 42 are provided for the receipt of appropriate mounting bolts therethrough in mounting the cabinet to a wall.

As further shown in FIG. 2, an inverted U-shaped track 24 is provided along the interior surface of the left sidewall 12 to receive the left side of a tambour door 22. As shown in FIG. 2, the track 24 is a groove into the interior surface of the left sidewall 12 but it is realized that other tracks may be provided for receipt of one longitudinal edge of the tambour door. Also, it is realized that left sidewall 12 is a mirror image of the right sidewall 14 and the right sidewall 14 will have an inverted U-shaped track 24 for receiving an opposed longitudinal edge of the tambour door 22. Sidewall 12 is also provided with a vertically extending groove 30 for receiving one-side of the intermediate wall 18. Also, bottom wall 16 is provided with a transversely extending groove 28 in alignment with the groove 30 for receipt of the bottom edge of the intermediate wall 18.

Figure 3:
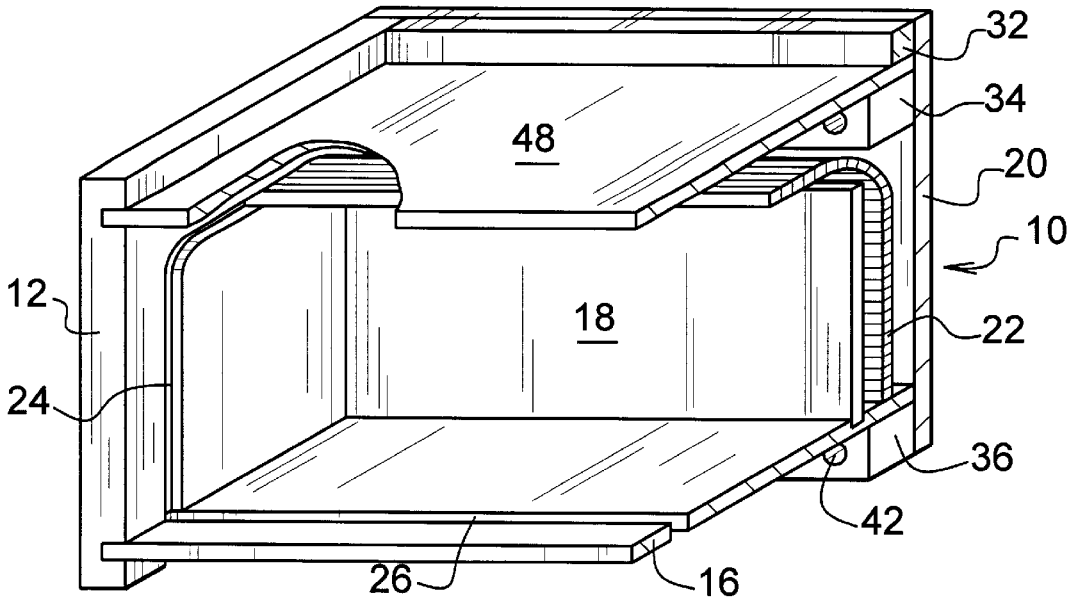
FIG. 3 is a perspective view of the preferred embodiment with other selected portions of the embodiment being removed.

As shown in FIG. 3, the tambour door 22 is in a completely opened position wherein door 22 is disposed between back wall 20 and intermediate wall 18. Moreover, as shown in FIG. 3, the bottom wall 16 is received within grooves of the inner surface of the sidewall 12 and opposed grooves in sidewall 14 (not shown). The slot 26 extends from the lower terminating end of the tracks 24 so that the tambour door 22 which has a width less than the slot 26 can be removed easily through the slot 26 when the slot 26 is in an open condition.

Figure 4:
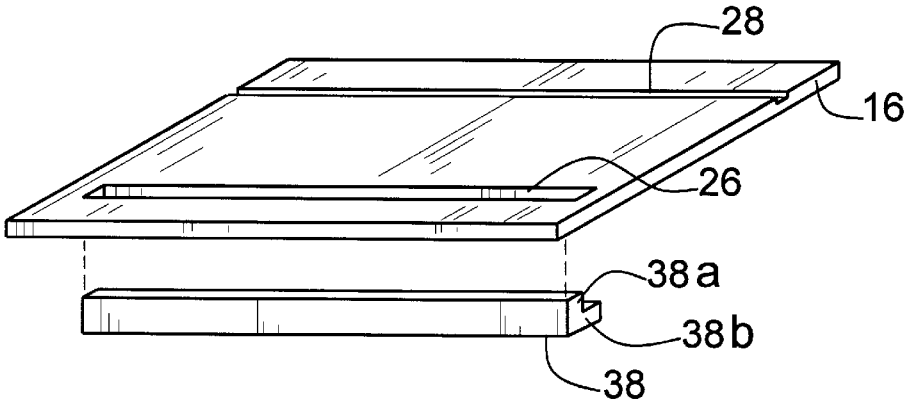
FIG. 4 is an exploded perspective view of a bottom wall of the preferred embodiment with a preferred removable closure for the slot of the bottom wall; and, FIG. 5 is a perspective sectional view of one portion of another preferred embodiment of the present invention.

Referring now to FIG. 4, FIG. 4 shows one embodiment of the present invention with the slot 26 having a removable closure member 38 of L-shaped configuration. The closure member 38 fits into the slot 26 with the thickness and height of leg 38*a* being the same as the thickness of the bottom wall 16 and the width of slot 26 thereby providing that the upper terminating edge of leg 38*a* fits flush with the inner surface of the bottom wall 16. Moreover, the horizontally extending leg 38*b* is positioned so that fastening bolts (not shown) may be utilized to attach the L-shaped closure 38 to the bottom wall 16.

Figure 5:
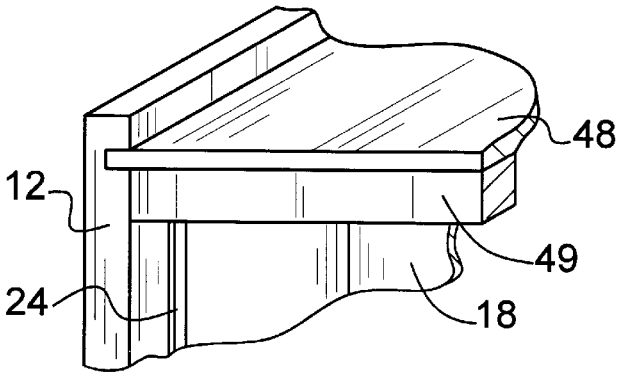

In FIG. 5 is shown a front wall 49 which extends horizontally between the sidewalls 12, 14 and vertically downward from top wall 48. Front wall 49 extends downwardly beyond the base portion of U-shaped tambour door tracks 24 so that the tambour door in its rolled up condition is not visible from outside cabinet 10.

In the removal of the tambour door 22 of the instant inventive cabinet merely removal of a closure, such as that shown and identified by numeral 38, enables the removal of the tambour door 22 downwardly through the slot 26 and replaced with another tambour door 22 of a different design or decorative slats thereon.

It is realized that the Figures are shown so as to enable easy reference to the essential elements of the present invention and that in a commercially available product the aesthetics may include other non-functioning structure, such as, for example a face frame, and the like. Furthermore, it will be realized that various changes may be made to the specific embodiment shown and described without departing from the scope and the spirit of the present invention as set forth in the appended claims.

What is claimed is:

1. A cabinet comprising:

a pair of spaced sidewalls;

a back wall extending between the sidewalls and an intermediate wall spaced between said sidewalls and connected thereto, said back wall and said intermediate wall being in parallel, said intermediate wall being disposed interiorly of said back wall;

a bottom wall extending between the sidewalls with a slot therein disposed along a front portion of said bottom wall, said slot spaced inwardly of a front side edge of said bottom wall, said slot being parallel to said intermediate wall and said back wall;

tambour door tracks of inverted U-shaped configuration extending along opposed inner surfaces of said sidewalls having one downwardly terminating end of each track being in alignment with said slot, each of said inverted U-shaped configured tracks having a first leg and a second leg with a base portion connected to said first and said second leg, said first leg being disposed on one side of said intermediate wall and said second leg being on an opposed side of said intermediate wall, said base portion being above an upper end of said intermediate wall; and, a removable tambour door mounted in said U-shaped tracks having a width less than said slot.

2. The cabinet of claim 1 including a detachably attached bottom plate member covering said slot.

3. The cabinet of claim 2, said bottom plate member being of L-shaped configuration, one leg having a thickness and height substantially the same as the width of said slot and the thickness of said bottom wall.

4. The cabinet of claim 3, said L-shaped member being bolt mounted to an undersurface of said bottom wall.

5. The cabinet of claim 2, said bottom plate member fitting flush with an inner surface of said bottom wall.

6. The cabinet of claim 1 including a top mounting block disposed along a back edge of said top wall.

7. The cabinet of claim 1 including a lower mounting block disposed along a back edge of said bottom wall.

8. The cabinet of claim 1 including a front wall extending horizontally between said sidewalls and vertically downward from said top wall a selected distance beyond said base portion of each of said U-shaped tracks.

* * * * *